US006293329B1

(12) United States Patent
Toti

(10) Patent No.: US 6,293,329 B1
(45) **Date of Patent: *Sep. 25, 2001**

(54) COIL SPRING DRIVE SYSTEM AND WINDOW COVER

(76) Inventor: Andrew J. Toti, 311 W. River Rd., Modesto, CA (US) 95351

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/989,148

(22) Filed: Dec. 11, 1997

Related U.S. Application Data

(63) Continuation-in-part of application No. 08/963,775, filed on Nov. 4, 1997.

(51) Int. Cl.[7] ..... E06B 9/30

(52) U.S. Cl. ..... 160/168.1 R; 160/170 R; 185/39

(58) Field of Search ..... 160/170 R, 168.1 P, 160/84.02, 84.04, 84.05, 190, 191, 192, 189, 313, 315, 318; 185/39

(56) References Cited

U.S. PATENT DOCUMENTS

| | | | | |
|---|---|---|---|---|
| 13,251 | | 7/1855 | Bixler . | |
| 2,266,160 | | 12/1941 | Burns . | |
| 2,276,716 | * | 3/1942 | Cardona | 160/170 R |
| 2,324,536 | | 7/1943 | Pratt . | |
| 2,390,826 | | 12/1945 | Cohn . | |
| 2,420,301 | | 5/1947 | Cusumano . | |
| 2,824,608 | | 2/1958 | Etten . | |
| 3,139,877 | * | 7/1964 | Graybill | 185/39 X |
| 4,399,959 | | 8/1983 | Godsoe . | |
| 4,472,910 | * | 9/1984 | Iha | 160/189 |
| 4,664,531 | | 5/1987 | King . | |
| 4,784,122 | | 11/1988 | Graham . | |
| 5,054,162 | | 10/1991 | Rogers . | |
| 5,482,100 | | 1/1996 | Kuhar . | |
| 5,531,257 | | 7/1996 | Kuhar . | |
| 5,615,729 | | 4/1997 | Matsumoto et al. . | |
| 5,813,447 | * | 9/1998 | Lysyj | 160/84.04 |

FOREIGN PATENT DOCUMENTS

| | | | | |
|---|---|---|---|---|
| 0796994A2 | | 9/1997 | (EP) . | |
| 883709 | * | 3/1943 | (FR) | 160/84.04 |
| 1068583 | * | 1/1984 | (SU) | 160/313 |

* cited by examiner

*Primary Examiner*—Blair M. Johnson
(74) *Attorney, Agent, or Firm*—Philip A. Dalton

(57) ABSTRACT

A coil spring drive unit for window covers is disclosed, which comprises a coil spring drive and the combination whose elements are selected from (1) a band shift transmission which provides varying ratio power transfer as the cover is opened and closed; (2) gear means comprising various gear sets which provide frictional holding force and fixed power transfer ratios; and (3) a gear transmission which provides fixed ratio power transfer as the cover is opened or closed. The combination permits the coil spring drive torque to be tailored to the weight characteristics of the window cover such as a horizontal slat or pleated or box blind as the blind is opened and closed, and permits the length of the blind and the distance between the open and closed positions of the blind to be altered for a given rotational distance of the coil spring.

5 Claims, 3 Drawing Sheets

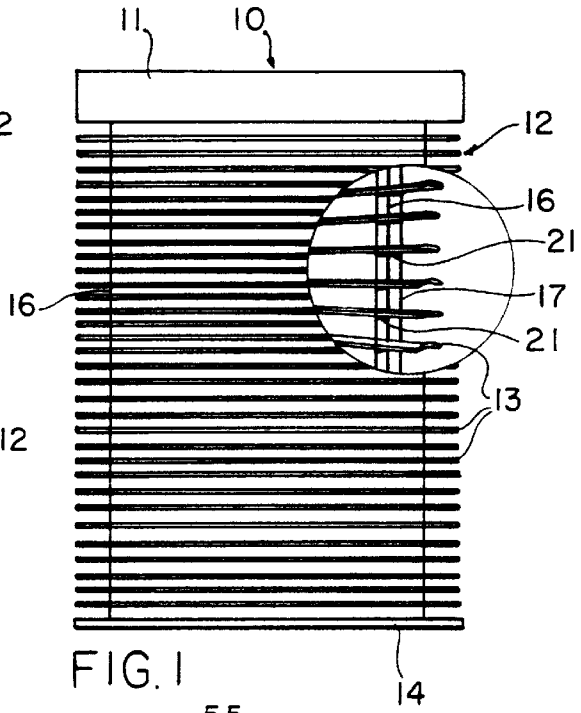
FIG. 1
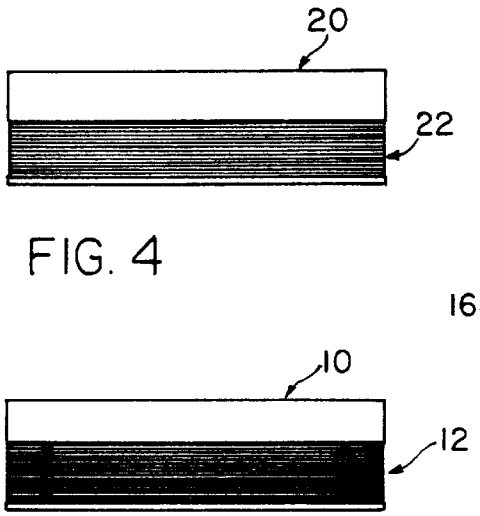
FIG. 2
FIG. 4
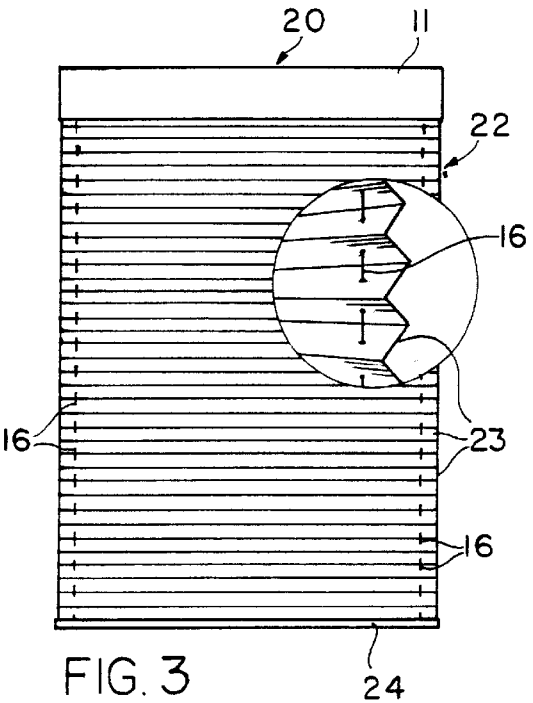
FIG. 3
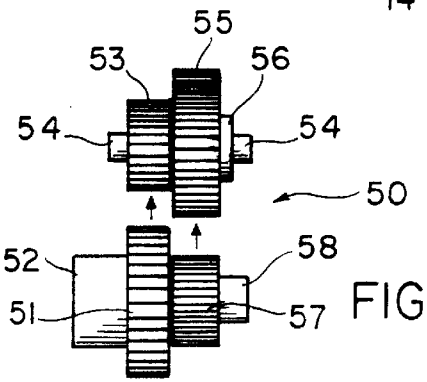
FIG. 6
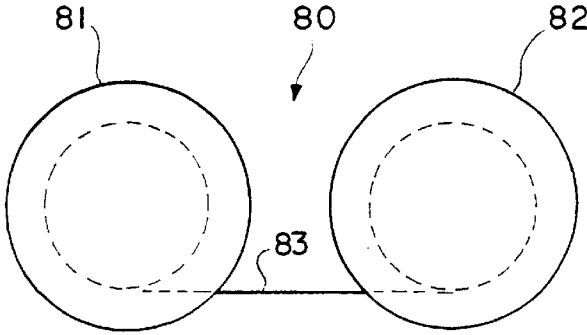
FIG. 8

COIL SPRING DRIVE SYSTEM AND WINDOW COVER

This is a continuation-in-part of application Ser. No. 08/963,775, titled COIL SPRING DRIVE SYSTEM FOR WINDOW COVER, filed Nov. 4, 1997, inventor Andrew J. Toti.

1. BACKGROUND OF THE INVENTION a. Field of the Invention

The present invention relates generally to coil spring drives or motors, which are useful in numerous applications and, in particular, to the application of such coil spring drives in window cover systems.

b. Definitions and Applicability

Typically, as used here, "cover" refers to expandable or extendible structures. These include slat structures such as so-called venetian or slat blinds and so-called mini-blinds. These structures also include pleated folding structures such as single and plural pleat structures and box, hollow and cellular structures. "Cover" also refers to flat, sheet-type covers such as roller blinds. In this document, "cover" and "blind" are frequently used interchangeably. As applied to such covers, "operate" refers to the process of closing and opening the covers, typically (for horizontal covers) to lowering and raising the cover.

As used here, "horizontal" window cover refers to horizontally oriented covers such as horizontal slat blinds, horizontal folded pleat blinds and horizontal cellular blinds. The present invention is applicable generally to horizontal window cover systems and to flat window cover systems. It is understood that "window," as used for example in "window cover," includes windows, doorways, openings in general and even non-opening areas or regions to which "window" covers are applied for decoration, display, etc.

c. Current State of the Relevant Field

Typically a horizontal cover or blind is mounted above a window or space which is to be covered, and is operated using lift cords to extend the cover and lower it across the area, stopping at a selected position at which the blind partially or fully covers the area. For typical horizontal slat blinds, the lift cords are attached to a bottom rail and the individual slats are supported by the cross members or "rungs" of a separate cord ladder. When the blind is fully lowered, each slat is supported by a rung of the cord ladder and relatively little weight is supported by the lift cords. However, as the blind is raised, the slats are "collected" on the bottom rail, and the support of the slats is thus increasingly transferred from the cord ladder to the bottom rail and the weight supported by the rail and the lift cords increases.

Typical pleated, cellular, box, etc., blinds are formed of resilient material having inherent spring-like characteristics. As the resilient blind is raised toward the fully open position, the blind material is increasingly compressed, and requires increasingly greater force to overcome the compression force and move the blind and hold the blind in position. Effectively, then, both the slat blind and the pleated blind require increasingly greater force to open the blind and to maintain the blind open than is required to close the blind and maintain the blind closed.

So-called coil spring drives have operating characteristics which make it difficult to assist the opening and closing operation of blinds such as horizontal and flat blinds. As applied to downward-closing embodiments of such blinds, coil spring drives typically are mounted at the top of the blind, and are operatively connected or coupled to the shaft about which the blind lift cord is wound. As described above, as the blind is lowered, the slat weight supported by the lift cords decreases and the compression force of the pleats decreases. However, as the blind is lowered, the spring is wound and the energy stored in the spring increases, such that the increasing torque or force of the spring may then raise the blind in fast, uncontrolled fashion. Also, it may be difficult to keep the blind at a selected position. Furthermore, if the blind is heavy, and requires a strong spring to maintain the blind open, the blind is particularly susceptible to instability and uncontrolled raising operation when partially or fully extended or closed. Conversely, when the blind is at or near the upper limit of its travel (i.e., is open), the slat weight supported by the lift cords and the pleat compression is at or near maximum, while the spring torque is at or near minimum. In this position, then, unless the spring is strong (perhaps causing uncontrolled operation), the spring torque may be insufficient to keep the blind open.

Frequently, prior art coil spring drives use latching mechanisms in an attempt to hold the blind or cover in position.

2. SUMMARY OF THE INVENTION

In one aspect, the present invention is embodied in a spring drive unit comprising a shaft; a coil spring mounted around a shaft and having a fixed end and a rotatable end; and a gear transmission of fixed drive ratio, operatively connected at one end to the rotatable spring end and operatively connected at the opposite end to the shaft. As a result of this arrangement, the transmission applies holding friction to the shaft and applies the fixed drive ratio between the coil spring and the shaft, determining the ratio of the shaft rotational distance to the spring winding distance and thereby controlling the force applied to the shaft by the spring. In another related aspect, the spring drive unit further comprises a band transmission of continuously varying drive ratio, which is itself operatively connected at one end to the rotatable spring end and operatively connected at the opposite end to the shaft, for applying the continuously varying drive ratio between the coil spring and the shaft to continuously vary the force applied to the shaft by the spring and to continuously vary the ratio of the shaft rotational distance and the spring winding distance.

In another aspect, the present invention is embodied in a spring drive unit comprising a shaft; a coil spring mounted around the shaft and having a fixed end and a rotatable end; and a band transmission of continuously varying drive ratio, operatively connected at one end to the rotatable spring end and operatively connected at the opposite end to the shaft. As a result of this arrangement, the band transmission applies said continuously varying drive ratio between the coil spring and the shaft to continuously vary the force applied to the shaft by the spring and to continuously vary the ratio of the shaft rotational distance and the spring winding distance. In another related aspect, the spring drive unit further comprises a gear transmission of given drive ratio, which itself is operatively connected at one end to the rotatable spring end and is operatively connected at the opposite end to the shaft, for applying the given drive ratio to the shaft to fixedly alter the force applied to the shaft by the spring and to fixedly alter the ratio of the shaft rotational distance to the spring winding distance, and for applying inherent holding friction to the shaft.

In another aspect, the present invention is embodied in a window cover system comprising an extendible window cover; lift means including lift cords attached to the cover for raising and lowering the extendible cover to selected positions; and a spring drive unit connected to the lift cords for assisting the raising and lowering of the cover. The spring drive unit comprises a shaft; a coil spring mounted around the shaft and having a fixed end and a rotatable end; and a gear transmission of given (fixed) drive ratio, the transmission connected at one end to the rotatable spring end and at the opposite end to the lift cords. As a result of this arrangement, the transmission applies holding friction to the lift cord-supported cover and applies the given drive ratio between the coil spring and the lift cords, determining the ratio of the cover travel distance to the spring winding distance and thereby controlling the force applied to the cover by the spring.

In an alternative spring drive embodiment, the spring drive unit comprises a shaft; a coil spring mounted along the shaft and having a fixed end and a rotatable end; and a band shift transmission of varying drive ratio. The band shift transmission is connected at one end to the rotatable coil spring end and at the opposite end to the lift cords. As a result, the band shift transmission applies said varying drive ratio between the coil spring and the lift cord, thereby varying the ratio of the cover travel distance to the spring winding distance as the cover is raised and lowered, and controls the force applied to the cover by the spring.

In another aspect, the spring drive unit further comprises gear means connecting the coil spring to the band shift transmission. The gear means comprises a set of bevel gears and a second set of gears, preferably direct gears. The bevel gears are connected at one end to the spring free end for rotation therewith and at the opposite end mesh with one end of the direct gears for rotation therewith. The direct gears are connected at the opposite end to one end of the band shift transmission for rotation therewith. The opposite end of the band shift transmission is connected to the lift cord pulleys for rotation therewith. As a result of this arrangement, the gear means applies holding friction to the lift cord-supported cover. Also, the gear means has a given (fixed) drive ratio which further contributes to the overall ratio of the cover travel distance to the spring winding distance and so controls the force applied to the cover by the spring.

In yet another aspect, the gear means comprises a gear transmission of given drive ratio, which is connected between the band shift transmission and the direct gear set, with one end of the transmission connected to said opposite end of the direct gear set and the opposite end of the transmission connected to said one end of the band shift transmission. The gear transmission thereby applies additional holding friction to the lift cord-supported cover and applies the given ratio between the coil spring and the lift cord, further changing the overall ratio of the cover travel distance to the spring winding distance and the force applied to the cover by the coil spring.

Other embodiments of the present invention are described in the specification drawings and claims.

3. BRIEF DESCRIPTION OF THE DRAWINGS

The above and other aspects of the invention are described below in conjunction with the following drawings.

FIG. 1 is a front elevation view of a horizontal slat blind window cover system, showing the cover in a lowered (closed) condition.

FIG. 2 is a front elevation view of the window cover system of FIG. 1, showing the cover in a nearly fully-raised (nearly open) condition.

FIG. 3 is a front elevation view of a horizontal pleated blind window cover system, showing the cover in a lowered (closed) condition.

FIG. 4 is a front elevation view of the window cover system of FIG. 3, showing the cover in a nearly fully-raised (nearly open) condition.

FIG. 6 is an exploded view of the gear transmission of FIG. 5.

FIG. 8 is a front elevation view of the band shift transmission of FIG. 7.

Figure 5:
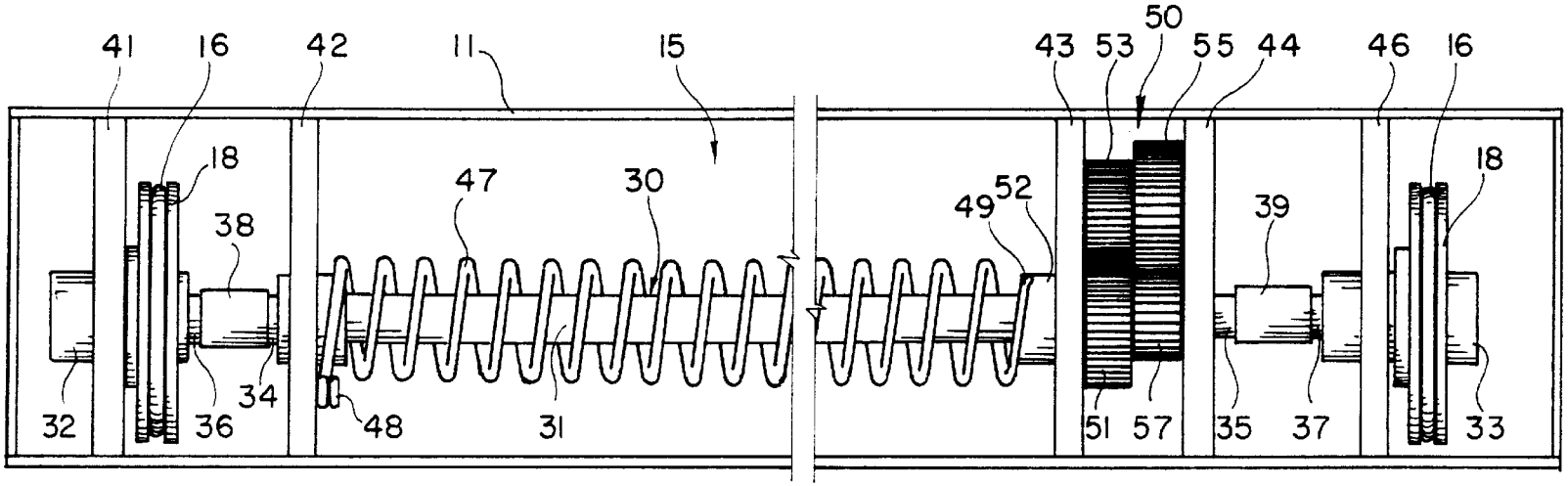
FIG. 5 is a simplified top plan view of a coil spring drive unit in accordance with the present invention, a coil spring drive unit adapted for use in the window cover system of FIGS. 1–4
Figure 10:
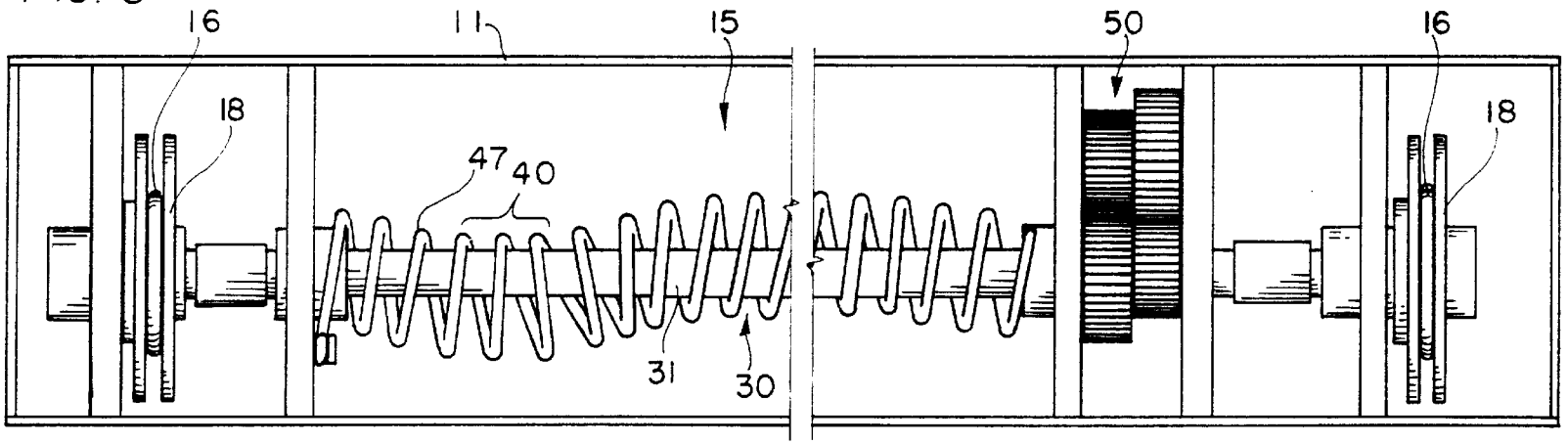
FIG. 10 is a simplified top plan view of the coil spring drive unit of FIG. 5, showing the binding of the spring coils on the shaft when the spring is relatively fully wound and the associated cover is extended at or near the closed condition.

Please note, the coil springs illustrated in the above drawing figures are simplified, with enlarged spacing between the coils, to better illustrate the shaft and other components. For example, the individual coils of the spring shown in FIGS. 5 and 10 are packed together, and in fact the increased packing of the wound spring is at least partially responsible for the binding illustrated in FIG. 10.

4. DETAILED DESCRIPTION OF THE PREFERRED EMBODIMENT(S)

As used here, the term "operatively connected" includes both direct connections of one component to another without intervening components and connections via intervening components including gears, transmissions, etc.

FIGS. 1 and 2 depict an exemplary horizontal slat (venetian) blind cover system 10 in closed (fully lowered) and nearly fully open positions, respectively. Typically, the blind cover system 10 comprises an elongated support member or housing 11 within which is mounted a coil spring drive unit such as unit 15, FIG. 5. The associated blind 12 comprises horizontal slats 13 and a bottom rail 14 which can be the same as the slats but, preferably, is sufficiently heavy, or is weighted, to impart stability to the blind.

FIGS. 3 and 4 depict a second exemplary, horizontal pleated blind cover system 20 in closed and nearly fully opened positions, respectively. Typically, the blind cover system 20 comprises elongated support member or housing 11 within which the coil spring drive unit 15 or other suitable spring drive unit is mounted. The associated blind 22 typically comprises light weight fabric or other material which is resilient and maintains the shape of the horizontal pleats 23. The blind also includes a bottom rail 24 which is sufficiently heavy, or weighted, to provide stability to the blind 22.

Referring also to FIG. 5, the illustrated spring drive unit 15 includes a shaft 30 comprising middle shaft or section 31 and left and right end shafts or sections 32 and 33. Adjacent ends 34, 36 of the middle and left shafts and adjacent ends 35, 37 of the middle and right shafts have reduced radius or size and are joined by collars 38 and 39. The separate shaft sections facilitate removal of the shaft 30 and installation and replacement of the drive components mounted on the shaft. The shaft 30 is rotatably journaled within transverse frame members 41, 42, 43, 44 and 46. Cord pulleys 18 are mounted on the shaft 30 adjacent supports 41 and 46, respectively. Spaced blind lift cords 16 are attached to bottom rail 14 (blind 10, FIG. 1), or to bottom rail 24 (blind 20, FIG. 3) and are wound about the pulleys 18 for raising and lowering the attached bottom slat or rail and thus the blind 10 or 20.

Regarding slat blind 10, FIGS. 1 and 2, and as is typical of such blinds, spaced cord ladders 17 are suspended from the support 11 and the cross members 21 of the ladders are routed along and/or attached the underside of the individual slats 13 so that when the ladders are fully extended (lowered) and the blind 12 is thus fully lowered, as depicted in FIG. 1, the weight of each slat is supported by the ladders, with little weight on the lift cords. In contrast, as the blind 12 is raised from the lowermost position, for example to the partially raised/lowered position depicted in FIG. 2, the slats are sequentially "collected" on the bottom rail 14, starting with the bottommost slats, so that an increasing weight is supported on the bottom rail and by the lift cords 16. Thus, and perhaps counter-intuitively, the weight supported by the lift cords is a maximum when the blind is fully open (raised), and a minimum when the blind is fully closed (lowered).

As discussed previously, the force requirements of horizontal pleated blinds such as blind 20, FIGS. 3 and 4 are somewhat similar to the slat blind 10 in that the compression of the pleats 23 increasingly opposes movement of the blind as it is raised, thus increasing the force required to open the blind and to maintain the blind in position. Conversely, the decreasing compression of the material as the blind is lowered toward the closed position decreases the force requirement.

Referring again to FIG. 5, coil spring 47 is positioned between supports 42 and 43, and is positioned around middle shaft section 31 (that is, the shaft 31 is inside the spring coils), for independent rotation around the shaft 30. A first end of the coil spring 47 is attached by fastener 48 to support 42 so that the first end (illustratively, the left end) does not rotate. The opposite (right) end of the coil spring is attached by fastener 49 to gear sleeve 52 of transmission 50. As described in detail below, that sleeve is connected to transmission idler gear 51, so that the right end of the spring 47 rotates with the idler gear 51 of the transmission 50 and vice versa. The transmission 50 is designed to offset the normal operating characteristics of the coil spring 47. The stored energy of the spring increases as the spring is wound when the blind 10 or 20 is lowered and thus the increasing torque of the spring increasingly opposes lowering the blind. In short, the spring torque increases as the blind is lowered, while the lift cord-supported slat weight or the pleat compression is decreasing. Conversely, when the blind is raised, under the impetus or assistance of the spring, the stored spring energy and associated spring torque decrease, while the supported slat weight or the pleat compression of the raising blind is increasing.

Referring to FIGS. 5 and 6, in one illustrated exemplary embodiment, the transmission 50 comprises an array of gears 51, 53, 55 and 57, in which idler gears 51 and 53 are intermeshed and idler gear 55 and power gear 57 are intermeshed. Idler gear 51 and integral sleeve or collar 52 are mounted on and free to rotate about shaft section 35. Gears 53 and 55 are joined, forming a gear set. This gear set and integral collar 56 are mounted on shaft 54, which is mounted to and between supports 43 and 44. The gear set and the collar rotate around shaft 54 and/or shaft 54 itself is mounted for rotation. Power gear 57 and integral collar 58 are mounted on and fastened to shaft section 35. Power gear 57 meshes with gear 55 of the two-gear set, the other gear 53 of which meshes with idler gear 51.

As mentioned, shaft end section 35 is part of the interconnected shafts (or shaft sections) 31, 32, 33. Thus, at one end of the transmission gear train, power gear 57 is joined to and rotates at the same rate as the shaft 30. At the opposite end of the transmission gear train, idler gear 51 rotates freely about the shaft 30 and is fastened to the free spring end by fastener 49, so that the idler gear 51 and coil spring 47 rotate at the same rate. As the result of this arrangement, the pulleys 18 and lift cords 16 rotate at one rate, the same rate as gear 57 and shaft 30, and the coil spring 47 rotates at another rate, the same rate as gear 51. The transmission gear ratio is selected so that the idler gear 51 and coil spring 47 preferably rotate at a slower rate than the power gear 57 and the lift cord pulleys 18. For example in one application, the fixed drive ratio of transmission 50 is 1:3 to 1:8 so that gear 57 and pulleys 18 rotate 3–8 revolutions for each revolution of the gear 51 and coil spring 47.

The above transmission gear ratios and the different rotation rates diminish proportionately the wind up of the spring 47 and the rate at which the torque exerted by the spring 47 increases as it is wound and the blind is lowered. This permits the use of a powerful spring to hold a large, heavy blind in position at the uppermost position, where the supported weight (or the pleat compression force) is the greatest, and diminishes the inherent rate of increase of the torque exerted by the spring as the blind is moved toward the lowermost, closed condition where the supported weight (the pleat compression force) is a minimum. Also, and referring to FIG. 10, as the spring winds up, it buckles in serpentine fashion along the shaft 31, and contacts the shaft at a multiplicity of locations 40 (only one such location 40 is shown), exerting pressure on the shaft and preventing the shaft from turning on its own, thereby providing braking action against shaft rotation. The braking helps keep the shaft and pull cord from moving when at rest but does not impede raising and lowering movement. Furthermore, the transmission 50 has inherent friction which acts as a brake and helps retain the blind at the selected positions between and including fully opened and fully closed.

As a result of the above factors, the spring does not overpower the weight of the blind and does not uncontrollably raise the blind. The transmission gear ratio also increases the length of travel available to the blind for a given spring, permitting a longer blind for a given spring or a given spring travel. The combination of the coil spring, transmission fixed gear ratio, gear friction and the spring buckling braking action allows the spring drive unit 15 to hold the blind 10, 20 in position at even the "heaviest" (uppermost) blind positions, prevents the spring from overpowering the blind, especially when the spring is wound (at the lower blind positions), and allows the blind to be pulled downward to any selected position by gently pulling the blind to that position and, conversely, to be pushed upward to any selected position by gently pushing upward to that position. Little force is required to move the blind up and down, the blind stops accurately at any selected position between and including the fully opened and fully closed positions, and the blind remains at the selected positions.

As an example of the improved operation resulting from the use of a spring drive 15, when a standard coil spring was used in 3'×4' DUETTE hollow pleat blind, near the end of the 4' travel of the blind, the increasing spring torque became too great for stable operation and overpowered the weight of the blind, retracting the blind. The use of spring unit 15 comprising the same standard coil spring as before and the gear transmission, in a 4'×6' DUETTE hollow ; pleat blind provided smooth stable operation in which the blind stayed in position, even in the 6' fully extended, fully closed position. The 6' travel effected sufficient buckling to provide braking action which assisted in keeping the blind at rest. In contrast, the 4' travel of the smaller 3'×4' blind did not cause enough buckling to noticeably effect buckling braking.

Figure 7:
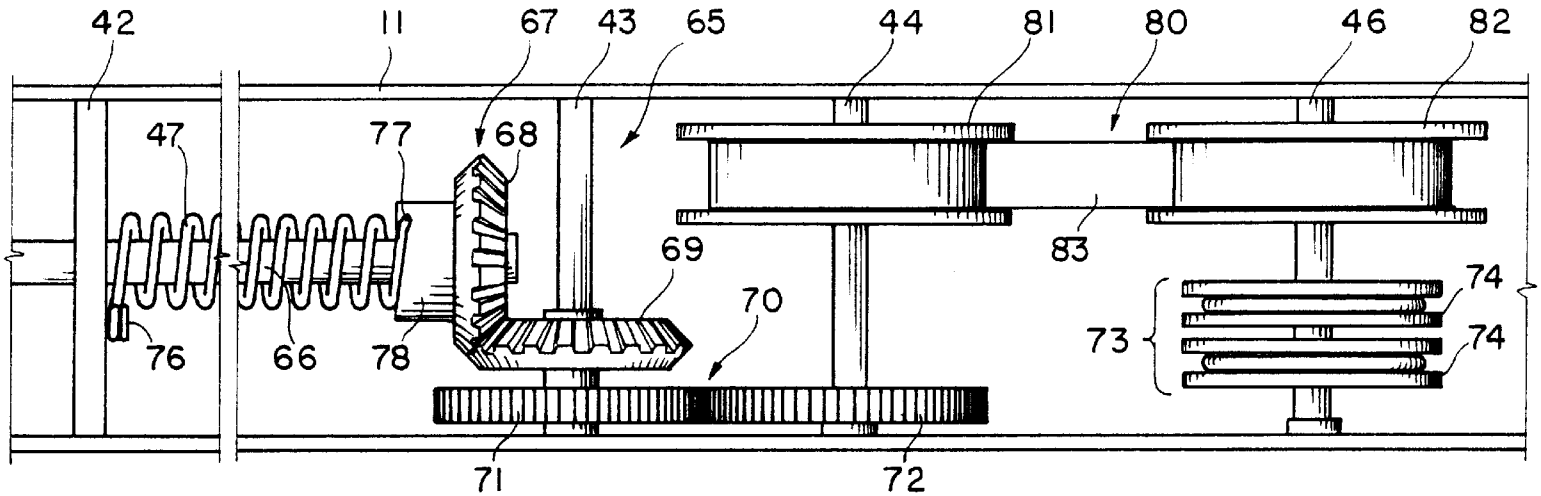
FIG. 7 is a simplified top plan view of an alternative coil spring drive unit in accordance with the present invention, one which comprises a coil spring drive, a band shift transmission, and connecting gear units, in accordance with the present invention.

FIG. 7 depicts an alternative spring coil drive unit 65 which comprises a coil drive spring 47, fixed ratio gear sets or transmissions 67 and 70, and a continuously varying, varied ratio, cord or band shift transmission 80. Preferably transmissions 67 and 70 are direct drive but can be other ratios as well. Illustratively, the support or housing 11 includes transverse supports including support 42, and transverse shafts 43, 44 and 46. The spring 47 is mounted along and freely rotatable around a longitudinal shaft 66, which is journal mounted to spaced transverse supports (only one, 42, of these two supports is shown). One end of coil spring 47 is mounted to support 42 by fastener 76, and the opposite end of the spring is attached by fastener 77 to the collar 78 of gear 68 of bevel gear set 67. Mating bevel gear 69 is mounted on transverse shaft 43, interconnected to gear 71 of preferably direct drive transmission 70. Adjacent gear 72 of the transmission 70 is mounted on transverse shaft 44 and meshes with gear 71.

Referring also to FIG. 8, band shift transmission 80 comprises output drum 81 (or spool) and storage drum 82 (or spool) about which a band 83 is wrapped. Preferably, the cord or band 83 is an elongated strip of thin cloth or thin steel having a flat rectangular cross-section. However, other suitable materials can be used, and other cross-section shapes can be used which provide controlled variation in the radii on the drums. Hereafter the term "band" will be used in accordance with the preferred embodiment of a thin, flat rectangular, but with the understanding that "bands" of other suitable cross-section shape can be used as well. The band shift transmission (hereafter band transmission) provides a varying drive ratio which is used to increase or diminish the torque or force of the spring drive unit. The cord or band transmission applies the varying drive ratio between the spring drive and the lift cord pulleys. The ratio of the band transmission is determined by the radius of the band stored on each drum. The radii vary as the band winds and unwinds, varying the associated gear ratio. Thus, increasing (decreasing) the thickness of the band, increases the rate at which the radii increase and decrease, and increases the gear ratio provided by the transmission. By way of example but not limitation, a band thickness of 0.014 inches has given satisfactory results. The manner of mounting the band can be used to decrease or increase the ratio of the speed of the spring output drum relative to that of the lift cord pulleys as the blind is lowered.

Referring further to FIG. 8, output drum 81 is mounted on the shaft 44 with gear 72 and take-up drum 82 is mounted on transverse shaft 46 along with cord pulley unit 73. This is a conventional pulley unit, about whose pulley(s) 74 are wound the spaced lift cords 16 which support the blind, such as blind 10, 20. Structurally, the pulley unit 73 differs from pulleys 18 in that pulleys 74 and 75 are mounted together on a transverse shaft near the right end of the blind, necessitating that one of the cords be routed to the left side of the blind. The pulleys 74 operate the same as pulleys 18.

As shown in FIG. 7, the direct drive transmission 70 and the pulley unit 73 are mounted parallel to the band shift transmission 80, reducing the overall length of the spring drive unit 65. The ratio of the band shift transmission is determined by the radius of the band stored on each drum. The radii vary as the spring 47 winds and unwinds, continuously varying the associated gear ratio. As mentioned, the band mounting can be used to decrease or increase the ratio of the winding or rotational velocity of the spring relative to that of the pulleys as the blind is lowered. Preferably, the band 83 is mounted so the band radius on output drum 82 increases (alternatively, decreases) relative to the band radius on storage drum 81 as the blind is lowered (raised) and the cord-supported weight decreases (increases), thus offsetting somewhat or decreasing the increasing power with which the spring opposes the blind during lowering operation, and offsetting or decreasing somewhat the decreasing lifting power of the spring during raising of the blind, and increasing the distance traveled by the blind relative to the spring drive and thereby increasing the maximum operational length of the blind (the distance between the fully raised and fully lowered positions.

In short, the continuously varying ratio, band shift transmission 80 continuously alters (preferably decreases) the rate at which the spring winds up and the torque increases as the blind is extended lower and alters (preferably increases) the operating length of the blind.

As mentioned, the operationally fixed ratios of bevel gear set 67 and gear set 70 can be direct drive, that is 1:1. Alternatively, the ratios can be smaller or greater than 1:1, to alter the overall ratio of the drive unit such as 65. The ratios also alter the maximum possible length of the blind and the distance between the open and closed positions of the blind for a given rotational distance traveled by the coil spring. For example, the ratio of at least one of these gear sets can be smaller than 1:1, as described for transmission 50, FIG. 5, and with similar results. Where the ratios of both bevel gear set 67 and gear set 70 are approximately 1:1, stopping the blind at any of selected positions and keeping the blind at the selected positions are effected by both (1) the continuously varying ratio of the band unit 83 which decreases the change in power of the coil spring as it winds and unwinds, (2) the friction of the bevel gear set 67 and the gear transmission 70, and (3) the "buckling" braking action of the spring 66.

Figure 9:
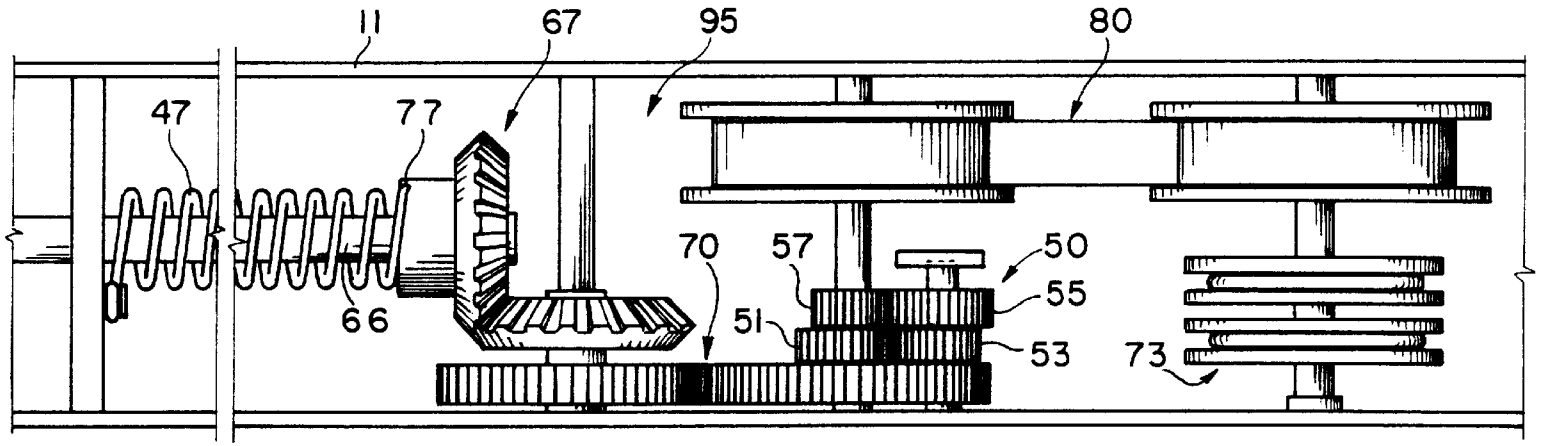
FIG. 9 is a top plan view of yet another alternative coil spring drive unit in accordance with the present invention, a coil spring drive unit which comprises a coil spring drive, a band shift transmission, a gear transmission, and connecting gear units, all in accordance with the present invention.

FIG. 9 depicts an alternative window spring coil drive unit 95 which adds the transmission 50 to drive unit 65. That is, coil spring drive unit 95 includes the drive components and functions of the drive unit 65 and the transmission 50 provides an additional fixed gear ratio for use in determining the overall ratio of the drive unit and for providing an additional frictional component which increases the stability of the blind at the selected rest positions.

The various components—gear transmission, shifting flat band transmission, gear set 65 and gear set 70—can be used alone or in essentially any combination to accommodate the weight and operational length of a given bind or cover.

The present invention has been described in terms of preferred and other embodiments. The invention, however, is not limited to the embodiments described and depicted. One familiar with the art to which the present invention pertains will appreciate from the various spring drive unit components and arrangements disclosed here, that the present invention is applicable in general to window covers which use spring drive units. Adaptation of the system to other articles, objects and systems, including other blinds will be readily done by those of usual skill in the art. The invention is defined by the claims appended hereto.

What is claimed is:

1. A window cover system of the type comprising an extendible window cover and lift means including lift cords attached to the cover for assisting extending and retracting the window cover, the system comprising:

a spring drive unit connected to the lift cords for assisting extending and retracting the cover to selected positions, the spring drive unit comprising a shaft mounted to a support member; a coil spring mounted along the shaft and having a fixed end and a rotatable end; and a gear transmission of selected drive ratio; the transmission connected at one output to the rotatable coil spring end and at a second output to the lift means, thereby applying the selected ratio between the coil spring and the lift cords, and determining the ratio of the cover travel distance to the spring winding distance and controlling the force applied to the cover by the spring; and the transmission having inherent friction opposing movement of the cover from the selected positions.

2. A window cover system comprising:

an extendible window cover; a support member; two rotatable pulleys mounted to the support member; lift cords attached to the cover and wrapped around the pulleys for assisting in extending and retracting the extendible cover; and a spring drive unit connected to the lift cords for assisting extending and retracting the cover to selected positions, the spring drive unit comprising a shaft mounted to the support member; a coil spring mounted along the shaft and having a fixed end and a rotatable end; and a gear transmission of selected drive ratio; the gear transmission connected at a first end to the rotatable coil spring end and at a second end to the lift cord pulleys, thereby applying the selected ratio between the coil spring and the lift cord pulleys, and varying the ratio of the cover travel distance to the spring winding distance and varying the force applied to the cover by the spring;

the gear transmission having internal friction opposing movement of the cover from the selected positions.

3. A window cover system of the type comprising an extendible window cover and lift cords attached to the cover and wrapped around pulleys mounted to a support member for extending and retracting the extendible cover, the system further comprising:

a spring drive, unit connected to the lift cords for assisting extending and retracting the cover to selected positions, the spring drive unit comprising a shaft; a spiral colt spring mounted along the shaft and having a fixed end and a rotatable end; a gear transmission of selected ratio, said gear transmission having first and second ends, and the first end thereof being connected to the rotatable coil spring end; and a band transmission of continuously varying drive ratio, the band transmission connected at a first end thereof to the second end of the gear transmission and at a second end thereof to the lift cord pulleys, the band transmission thereby applying said continuously varying drive ratio between the coil spring and the lift cord pulleys, for varying the ratio of the cover travel distance and the spring winding distance as the cover is extended and retracted, and varying the force applied to the cover by the spring as the cover is extended and retracted.

4. The window cover system of claim 3, further comprising an arrangement of gears connecting the coil spring to the band transmission, the arrangement of gears comprising a set of bevel gears and a second set of gears, the bevel gears connected at a first end thereof to the coil spring rotatable end for rotation therewith and connected at a second end thereof to a first end of the second set of gears for rotation therewith, the second set of gears connected at a second end thereof to the first end of the band transmission for rotation therewith; the arrangement of gears having a selected drive ratio further varying the overall ratio of the cover travel distance to the spring winding distance and further varying the force applied to the cover by the spring.

5. The window cover system of claim 4, the arrangement of gears further comprising a gear transmission of fixed drive ratio, the gear transmission connected between the band transmission and the second set of gears, with one end of the gear transmission connected to said opposite end of the second gear set and the opposite end of the gear transmission connected to said one end of the band transmission; the gear transmission thereby applying the fixed ratio between the coil spring and the lift cords, and determining the ratio of the cover travel distance to the spring winding distance and controlling the force applied to the cover by the spring; and the gear transmission having internal friction opposing movement of the drive shaft and the lift cord-supported cover and thereby maintaining the cover at the selected positions.

* * * * *